United States Patent [19]

Haanterä

[11] Patent Number: 4,494,476

[45] Date of Patent: Jan. 22, 1985

[54] METHOD AND APPARATUS FOR SUPPORTING LIGHTERS IN LIGHTER-TRANSPORT SHIPS

[75] Inventor: Antti I. Haanterä, Helsinki, Finland

[73] Assignee: Valmet Oy, Finland

[21] Appl. No.: 407,054

[22] Filed: Aug. 11, 1982

[30] Foreign Application Priority Data

Aug. 19, 1981 [FI] Finland ..... 812554

[51] Int. Cl.[3] ..... B63B 25/08

[52] U.S. Cl. ..... 114/260; 114/75

[58] Field of Search ..... 114/26, 72, 75, 258, 114/259, 260, 261, 262; 410/2, 52, 77, 30, 33, 65, 90, 92; 104/72, 73, 140, 146, 154, 155, 161; 105/243

[56] References Cited

U.S. PATENT DOCUMENTS

| | | | |
|---|---|---|---|
| 780,748 | 1/1905 | Hart et al. | 105/243 |
| 1,971,179 | 8/1934 | Gilpin | 410/30 |
| 2,118,364 | 5/1938 | Sheehan | 410/65 |
| 2,821,152 | 1/1958 | Podgajy | 410/65 |
| 3,508,764 | 4/1970 | Dobson et al. | 410/90 |
| 3,524,421 | 8/1970 | Schwendtner | 114/260 |
| 3,722,449 | 3/1973 | Goldman | 114/75 |
| 4,241,890 | 12/1980 | Pearson | 410/92 |

FOREIGN PATENT DOCUMENTS

| | | | |
|---|---|---|---|
| 1061358 | 7/1959 | Fed. Rep. of Germany | 104/161 |

*Primary Examiner*—Galen L. Barefoot
*Assistant Examiner*—Edwin L. Swinehart
*Attorney, Agent, or Firm*—Steinberg & Raskin

[57] ABSTRACT

In order to laterally support lighters provided with rails on their bottoms, the loading deck of a lighter-transport ship is provided with channels situated beneath and opening onto the upper surface of the deck which are adapted to receive the rails of the lighters, and cover plates associated with the channels for selectively closing the same. The cover plates are removed from the channels to open the same when lighters are supported on the deck so that the rails are received within the channel. The cover plates are shifted over the channels to close the same when wheeled loading vehicles are moved on the deck.

15 Claims, 3 Drawing Figures

METHOD AND APPARATUS FOR SUPPORTING LIGHTERS IN LIGHTER-TRANSPORT SHIPS

BACKGROUND OF THE INVENTION

The present invention relates generally to methods and apparatus in lighter-transport ships and, more particularly, to a method and apparatus for laterally supporting lighters having bottoms from which rails or the like project.

The desirability of providing lateral support for lighters on the decks of lighter-transport ships has been recognized. A conventional technique for providing such lateral support includes providing the bottom of the lighters with guide rails or keels which are supported against trestles fixed such as by welding to the deck of the lighter-transport ship and which project upwardly therefrom. The bottom keel of the lighter and the trestle thereby support the lighter in the lateral direction on the deck of the ship. Moreover, the sides of the lighter are fastened to the deck of the ship by means of diagonal rigging screws as is well known in the art.

However, since the trestles project upwardly from the deck of the lighter-transport ship, the use of wheeled loading vehicles on the deck constituting the load space of the ship is severely restricted. Furthermore, it is well known that lighter-transport ships are frequently used to carry containers and/or other loads on cargo platforms. Since the trestles would otherwise constitute an obstruction to the loading of the deck, special detachable adapters have been designed which are fitted on the trestles so that a plane base is provided for the containers or cargo platforms. It will be appreciated, however, that the use of such adapters is inconvenient and time-consuming. Moreover, such adapter structures are cumbersome so that their handling and storage create problems.

SUMMARY OF THE INVENTION

Accordingly, it is an object of the present invention to provide new and improved methods and apparatus for laterally supporting lighters whose bottoms are provided with rails or the like on the deck of lighter-transport ships.

Another object of the present invention is to provide new and improved methods and apparatus as described above which overcome the drawbacks inherent in the techniques wherein trestles or the like are used to provide lateral support.

Briefly, these and other objects are obtained by providing apparatus for laterally supporting a lighter having rail means provided on its bottom on the upper surface of a loading deck of a lighter-transport ship, the apparatus including channel means situated beneath and opening onto the upper surface of the deck, the channel means being adapted to receive the rail means of the lighter, and cover means operatively associated with the channel means for selectively closing the same. When the lighters are moved onto the loading deck, the cover means are removed from their covering positions so that the rails are received within the channel means thereby providing a good lateral support for the lighters. When it is desired to have wheeled loading vehicles enter onto the loading deck of the lighter-transport ship, the cover means are moved to their closed positions, i.e., to positions wherein the channel means are closed so that the channel means do not provide an obstacle to the travel of the wheeled vehicles over the area of the loading deck. It is noted that even when the cover means are shifted to the so-called open position wherein the channel means open onto the upper surface of the loading deck, load containers can be situated on the loading deck without encountering problems similar to those presented by conventional arrangements, i.e., wherein trestles project upwardly from the loading deck of the lighter-transport ship.

Guide and counter means are associated with the channel means in order to facilitate the guidance of the lighter rails into the channel means and to support the cover means when the latter are shifted so as to close the channel means.

In accordance with one embodiment of the invention, channels are formed on the loading deck of the lighter-transport ship which extend longitudinally so as to be adapted to receive the bottom rails of the lighters. The channels are constructed by welding appropriate wall-forming members beneath the deck of the ship. When the deck of the ship is loaded by wheeled vehicles, the channels are closed by appropriate cover means, which may be constituted by movable plate-shaped or equivalent structures, which may be pivotally, laterally or otherwise mounted so as to be shiftable between the open and closed positions.

Guide and counter means are situated within the channels and are constituted by a substantially diagonally extending wall portion and an integral horizontal wall portion. When lighters are received onto the loading deck, the covers are in their open position and the diagonal wall portions of the guide and counter means, which may be welded within the channels, facilitate the guidance of the bottom rails of the lighters into their positions and act to prevent lateral movement during sea transport. When the covers are in their closed positions, the horizontal wall portions of the guide and counter means support the covers within the channels.

If desired, the lighters may be fixed during sea transport in a conventional manner by means of rigging screws or the like fitted between the lower portions of the vertical sides of the lighter and the deck of the ship.

DESCRIPTION OF THE DRAWINGS

A more complete appreciation of the present invention and many of the attendant advantages thereof will be readily understood by references to the following detailed description when considered in connection with the accompanying drawings in which.

DESCRIPTION OF THE PREFERRED EMBODIMENTS

Figure 1:
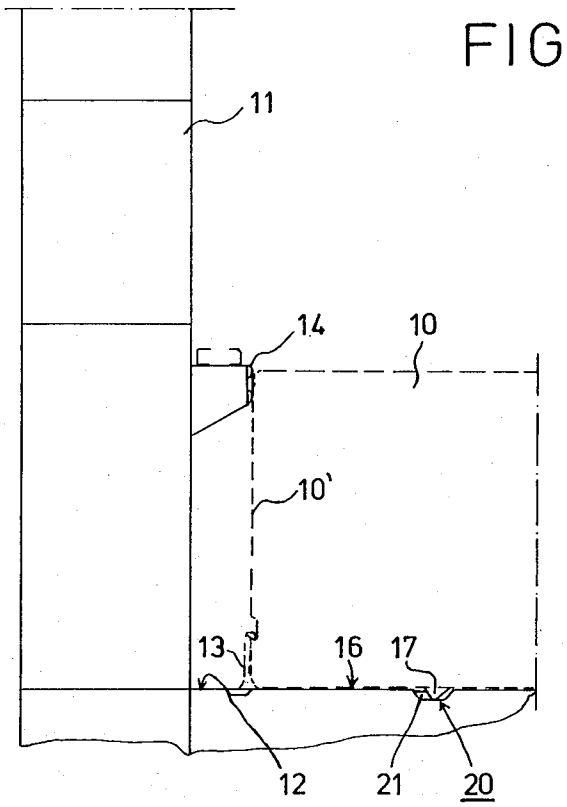
FIG. 1 is a fragmentary schematic cross-sectional view of the deck and hold wall of a lighter-transport ship in accordance with the present invention and illustrating a lighter laterally supported thereon, the lighter being shown in phantom.

Referring now to the drawings wherein like reference characters designate identical or corresponding parts throughout the several views, and more particularly to FIG. 1, one of the hold walls 11 and the loading deck 12 of a lighter-transport ship is illustrated. A lighter 10, illustrated in phantom, has been floated and then fixed onto the deck 12 in accordance with the invention. The bottom 16 of the lighter 10 is provided with a pair of longitudinally extending rails 17 (only one shown) which in accordance with the invention are received and supported within a pair of respective longitudinally extending channels 21 (only one shown). The channels 21 are situated beneath and open onto the upper surface of the deck 12. In the illustrated embodiment, the deck 12 is constituted by thick sheet material so that the channels actually extend beneath the entire deck although it is understood that it is within the scope of the invention to provide channels within the thickness of the deck when appropriate. The lower portions of the vertical sides 10' and 10" (FIG. 2) of the lighter 10 are attached to the deck 12 by means of rigging screws 13 which are known per se. The elements designated 14 are also conventional and serve to accurately position the lighters on the deck and facilitate the floating operation during flooding and evacuation of the hold. Certain apparatus, generally designated 20 in FIG. 1, are provided in association with the channels 21 in accordance with the invention as described in greater detail below.

Figure 2:
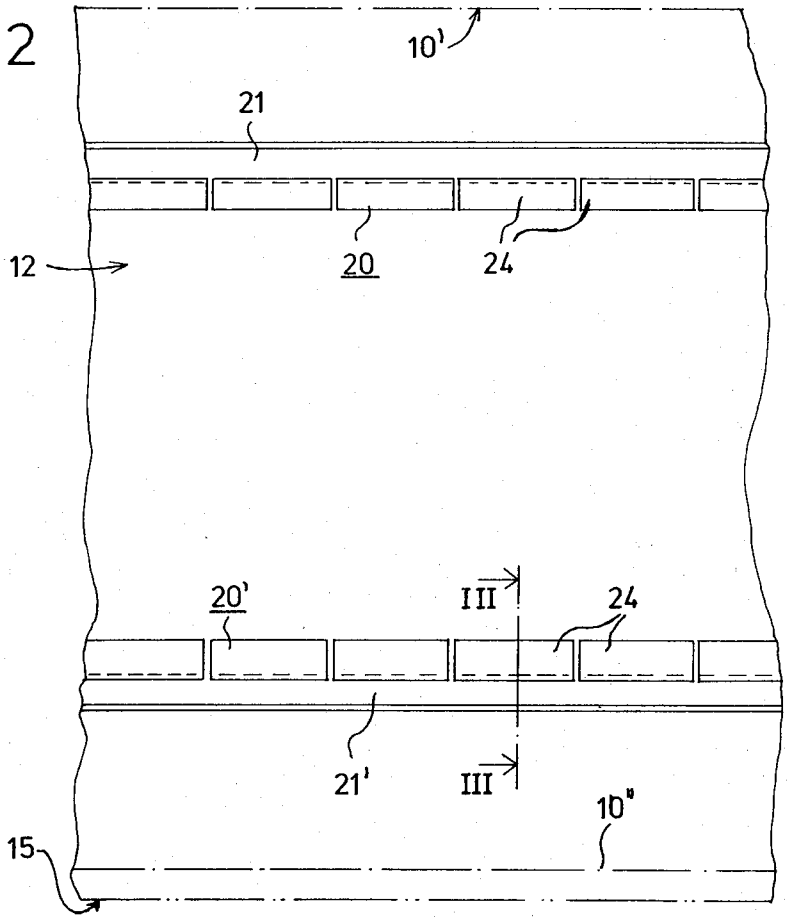
FIG. 2 is a fragmentary schematic plan view of the deck of a lighter-transport ship in accordance with the present invention.
Figure 3:
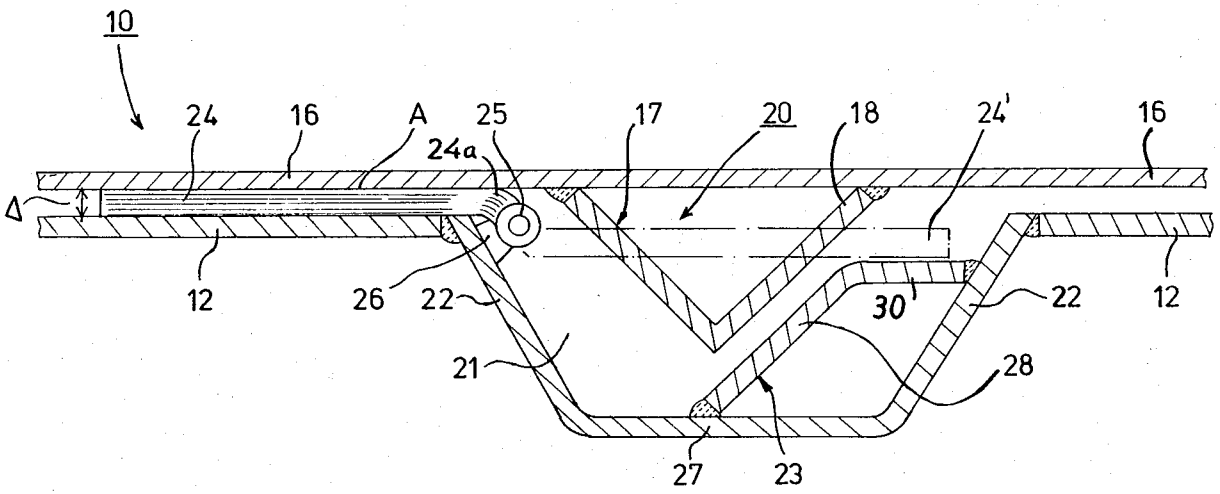
FIG. 3 is a section view taken along line III—III of FIG. 2.

Referring now to FIGS. 2 and 3, the channel means 21 and apparatus 20 will be described in greater detail in conjunction with the method of the present invention. In the illustrated embodiment, as noted above, a pair of rails 17 extend from the bottoms 16 of the lighters 10 and a corresponding pair of channels 21 and 21' are formed so as to longitudinally extend over the deck 12 substantially from one end to the other. Moreover, the line 15 in FIG. 2 denotes the center line of the deck 12 so that it will be understood that two longitudinally extending rows of lighters are receivable on the deck with two pairs of corresponding channels being provided. The reference characters 10' and 10" in FIG. 2 designate the sides of a lighter. Thus, two lighters can be accommodated in the hold of the ship situated in side-by-side fashion and three lighters can be situated in the longitudinal direction one after the other. Accordingly, there are four channels 21, 21' provided on the deck 12 of the hold which extend substantially over the entire length of the load space defined thereby.

The construction of channel 21 will now be described, it being understood that the channel 21' is substantially identical thereto. The channel 21 is defined by a trough-shaped member situated within a longitudinally extending slot provided in the deck 12, the upper ends of the trough-shaped member being welded to the spaced edges of the deck defining the slot. The trough-shaped member defines a pair of slanting channel side walls 22 and bottom wall 27. A guide and counter member 23 is situated within the channel 21 extending between the bottom wall 27 and one of the side walls 22 to which it is welded. The guide and counter member 23 is constituted by a substantially planar slanting guide wall portion 28 which extends at an angle with respect to the deck 12 and an integral substantially planar horizontally extending counter wall portion 30.

Hinge mounting flanges 26 are fixed to the upper regions of the other one of the side walls 22 of channel 21, the flanges 26 being provided with hinges 25. A plurality of plate-shaped covers 24 are provided in operative relationship with the channel 21 and 21', the covers 24 being situated one after the other along the channels as best seen in FIG. 2. Each of the plate-shaped covers 24 in the illustrated embodiment comprises a substantially rectangular and planar plate having an edge region 24*a* which extends at an angle with respect to the planar portion. Each cover 24 is mounted to the hinges 25 at the angled edge region 24*a* thereof so that each cover 24 can be pivoted manually around the hinges 25. In one preferred embodiment, the length of a single cover 24 in the direction of the channel 21 is about 1.5 meters.

The apparatus 20 and channels 21 and 21' operatively cooperate according to the method of the invention in the following manner. When lighters 10 are being loaded onto the deck 12 of the lighter-transport ship, the plate-shaped covers 24 are in the open position illustrated in FIGS. 2 and 3 so that the channels 21 and 21' open onto the upper surface of the deck 12. As seen in FIG. 3, when in their open positions, the covers 24 lie flushly on the upper surface of the deck. This is made possible by the provision of the angled edge region 24*a* of the cover 24 which extends to a slight extent into the space within the channel 21 where it is attached to the hinges 25 provided on the flanges 26 which are connected to the upper regions of a channel side wall 22. With the channels 21 and 21' being open, the lighters 10 are floated into the load space over deck 12 whereupon the water is evacuated from the hold with the lighters 10 being lowered until the rails 17 are guided into the channels 21 and 21'. The guidance of the rails into the corresponding channels is facilitated by means of the construction of the rails 17, i.e., through the provision of a slanting wall portion 18 which corresponds to the angled orientation of the guide wall portion 28 of the guide end counter member 23. When the water has been removed from the hold, the bottom 16 of the lighter is supported on the upper surface of the plate-shaped cover 24 which have been pivoted into the open position illustrated in FIG. 3. In this manner, an appropriate clearance Δ between the upper surface of the deck 12 and the bottom 16 of lighter 10 is provided. It is preferred that the magnitude of the clearance Δ be at least about 20 millimeters. Moreover, the surface area provided by the upwardly directed faced A of the covers 24 is sufficiently large to provide an adequate support surface for the lighters 10.

The launching of the lighters 10 from the hold is accomplished in a known manner by pumping water into the hold to float the lighters whereupon the latter are floated from the stern port of the ship.

In accordance with the invention, when the lighter-transport ship is used, for example, in the transportation of containers or other cargo which are loaded onto the deck by means of wheeled loading vehicles, the covers 24 are pivoted to their closed positions, shown in phantom as 24' in FIG. 3, whereby the channels 21 and 21' are closed. The free edge region of the covers 24, i.e., the edge regions of the covers which are opposite from the hinged edge regions 24*a*, bear against the horizontal surface presented by the counter wall portion of the guide and counter member 23. As seen in FIG. 3, when the covers 24' are in their closed position, their upper surfaces are substantially coplanar with the upper surface of the deck 12 and in this connection it is noted that although the upper surfaces of the covers 24 and deck 12 may not be precisely coplanar, the channels 21 and 21' will be covered so that the deck 12 will present a substantially continuous and even upper surface over which it is possible to drive wheeled vehicles without any difficulty. The term "substantially coplanar" will thus designate the feature whereby when the covers 24 are pivoted to their closed positions, the channels 21 and 21' will not present a substantial difficulty to the travel of wheeled vehicles thereover.

The present invention also has applicability to the situation wherein a ship is used for transporting railed vehicles, such as railroad cars. More particularly, the rails for receiving the railroad cars are situated within channels similar to those described above which are spaced apart from each other a distance equal to the wheel base of the trucks of the railroad cars. Detachable or pivotally mounted covers, similar to the covers 24, are provided so that the rail containing channels can be covered by the same whereby wheeled vehicles may also operate on the deck in a manner which is unobstructed by the rails.

Although the present invention has been described above in connection with an embodiment wherein the covers 24 are pivotally mounted in relation to the channels by means of hinges 25, it is within the scope of the present invention to provide plate-shaped covers which are slidably mounted in lieu of the pivotally mounted arrangement. Thus, the covers may be slidingly shifted onto and off from the channels 21 in a direction within the plane of the covers. In any event, the covers 24 must be suitably dimensioned to withstand the travel of wheeled vehicles thereover.

Furthermore, it is also within the scope of the present invention to utilize covers which are not mechanically mounted relative to the channels but which can be removed from the channels and stored within a suitable storage area. In this embodiment, when wheeled vehicles are used on the deck of the load space, the covers are placed onto the channels so as to close the same in the manner described above. The covers are removed and suitably stored when lighters are received onto the deck.

Obviously, numerous modifications and variations of the present invention are possible in the light of the above teachings. It is therefore to be understood that whein the scope of the claims appended hereto, the invention may be practiced otherwise than as specifically disclosed herein.

What is claimed is:

1. Apparatus for laterally supporting a lighter on the upper surface of a loading deck of a lighter-transport ship, the lighter having rail means provided on its bottom, comprising:

channel means situated beneath and opening onto the upper surface of said deck and adapted to receive the rail means of the lighter;

cover means operatively associated with said channel means for selectively closing said channel means, said cover means being substantially plate-shaped; and mounting means for mounting said plate-shaped cover means proximate to said channel means for movement between a first position wherein said channel means open onto the upper surface of said deck and a second position wherein said channel means are closed, said plate-shaped cover means having a thickness such that in said first position said plate-shaped cover means lie on the upper surface of said deck and support the bottom of said lighter so as to provide a clearance between the lighter bottom and the upper surface of said deck.

2. The combination of claim 1 further including guide means associated with said channel means for facilitating the guidance of the rail means into said channel means.

3. The combination of claim 2 wherein said guide means include a substantially planar wall portion situated within said channel means and which extend at an angle with respect to the upper surface of said deck.

4. The combination of claim 1 further including counter means associated with said channel means for supporting said cover means when the same close said channel means.

5. The combination of claim 4 wherein said counter means include a substantially planar wall portion situated within said channel means for supporting said cover means when the same close said channel means.

6. The combination of claim 1 further including guide and counter means associated with said channel means for facilitating the guidance of the rail means in said channel means and for supporting said cover means when the same close said channel means.

7. The combination of claim 6 wherein said guide and counter means include a unitary member situated within said channel means including a first substantially planar wall portion which extends at an angle with respect to the upper surface of said deck and a second substantially planar wall portion for supporting said cover means when the same close said channel means.

8. The combination of claim 1 wherein said mounting means comprise hinge means for mounting said plate-shaped cover means for pivotal movement between said first and second positions.

9. The combination of claim 8 wherein said channel means are defined by a bottom wall and opposed side walls extending downwardly from the upper surface of said deck and wherein said plate-shaped cover means comprise at least one substantially planar cover plate and wherein said hinge means hingedly attach an edge of said at least one cover plate to an upper region of one of said side walls of said channel means.

10. The combination of claim 1 wherein said plate-shaped cover means in said second position lies in a plane which is substantially coplanar with the upper surface of said deck.

11. The combination of claim 10 wherein said channel means are defined by a bottom wall and opposed side walls which extend downwardly from the upper surface of said deck and wherein said plate-shaped cover means comprise at least one substantially planar cover plate having an edge region extending at an angle with respect thereto, and wherein said mounting means comprise hinge means for hingedly attaching said angled edge region of said at least one cover plate to an upper region of said one of said side walls of said channel means.

12. The combination of claim 1 wherein said cover means include a plurality of cover plates situated one after the other in the longitudinal direction of said channel means and which are associated with said channel means to selectively close the same manually.

13. The combination of claim 1 wherein said channel means are defined by opposed slanting side walls and a substantially planar bottom wall, said cover means are substantially plate-shaped and have an edge portion, and further including guide and counter means associated with said channel means including a substantially planar top portion adapted to support said cover means at the end portions thereof when said cover means close said channel means.

14. The combination of claim 1 wherein said channel means substantially extend from one end of said deck to the other.

15. The combination of claim 1 wherein said channel means include a pair of longitudinally extending channels for each group of lighters which are longitudinally alignable on said deck.

* * * * *